US009638074B1

(12) United States Patent
Ploughe

(10) Patent No.: US 9,638,074 B1
(45) Date of Patent: May 2, 2017

(54) DUAL-LOBED CAM FOR A CAMSHAFT AND ENGINE ASSEMBLY

(71) Applicant: Kevin Ploughe, Mulberry, IN (US)

(72) Inventor: Kevin Ploughe, Mulberry, IN (US)

( * ) Notice: Subject to any disclaimer, the term of this patent is extended or adjusted under 35 U.S.C. 154(b) by 49 days.

(21) Appl. No.: 14/321,177

(22) Filed: Jul. 1, 2014

Related U.S. Application Data

(60) Provisional application No. 61/842,963, filed on Jul. 3, 2013.

(51) Int. Cl.
*F01L 1/04* (2006.01)
*F01L 1/34* (2006.01)

(52) U.S. Cl.
CPC ..... *F01L 1/34* (2013.01)

(58) Field of Classification Search
CPC ..... F01L 1/08; F01L 1/06; F01L 2001/054
USPC ..... 123/90.6
See application file for complete search history.

(56) References Cited

U.S. PATENT DOCUMENTS 5,529,032 A * 6/1996 Oikawa ..... F01L 1/08 123/90.16
2006/0272598 A1* 12/2006 Wakeman ..... F01L 1/08 123/21
2012/0145097 A1* 6/2012 Hayman ..... F01L 1/053 123/90.1

FOREIGN PATENT DOCUMENTS

DE 10201932 A1 * 7/2003 ..... F01L 1/047

* cited by examiner

*Primary Examiner* — Zelalem Eshete
(74) *Attorney, Agent, or Firm* — Benjamin M. Hanrahan; Hanrahan Law Firm, P.A.

(57) ABSTRACT

A dual-lobed cam for a camshaft of an internal combustion engine is presented herein. The camshaft includes an elongated shaft rotationally disposed in relation to a crankshaft via a timing assembly. The dual-lobed cam includes an enlarged base circle region circumferentially disposed around the camshaft, with two oppositely disposed lobes extending therefrom. The lobes define lift regions off of the base circle which drivingly engage a valve assembly. The camshaft disclosed herein may include a rotational speed of one-fourth the rotational speed of a crankshaft or crankshaft sprocket, thereby preserving power and increasing efficiency of the overall engine.

18 Claims, 9 Drawing Sheets

DUAL-LOBED CAM FOR A CAMSHAFT AND ENGINE ASSEMBLY

CLAIM OF PRIORITY/CROSS REFERENCE TO RELATED APPLICATION

The present application is based on and a claim to priority is made under 35 U.S.C. §119(e) to provisional patent application Ser. No. 61/842,963, having a filing date of Jul. 3, 2013, the contents of which are incorporated herein their entirety.

FIELD OF THE INVENTION

The present invention is generally directed to a dual-lobed cam for a camshaft of an internal combustion engine, the dual-lobed cam having a two lobes disposed on opposite sides of the cam base circle, or one hundred and eighty degrees apart from one another. In this manner, the rotational speed of the dual-lobed cam will be significantly lower (e.g., half) that of a conventional cam, and one fourth that of the crankshaft.

BACKGROUND OF THE INVENTION

Engine efficiency and power is a growing concern and has been the subject of various technological advancements in the automotive industry for many years. However, many of these technological advancements do not operate to reduce the torque or energy that is required to turn the camshaft and thereby operate the engine. An improved engine that uses less torque turning or operating the camshaft will result in that power being returned to the crankshaft or other portions of the engine or vehicle for higher power output or higher overall efficiency. It should also be noted that an engine that is more efficient can be built smaller to output the same power as a larger engine.

Accordingly, there is a need in the art for an improved cam or camshaft that would result in less power required to drive the cams or camshaft, thereby resulting in a vehicle and engine with higher efficiency and/or power. The proposed invention relates to a camshaft or an improved cam which can reduce the rotational speed of the camshaft by half, or otherwise cause the camshaft to rotate at one fourth the speed of the crankshaft in a typical four stroke internal combustion engine. This would cause the camshaft to turn one full revolution for every eight strokes of the rotating assembly.

In particular, the proposed invention would include a cam or a plurality of cams with two lobes, disposed approximately one hundred and eighty degree apart on the same base circle. The first lobe would operate a valve, push rod, etc. during one four stroke cycle, followed by the second lobe operating the same valve, push rod, etc. during the next four stroke cycle, and so on.

In order to accomplish this, additional structural characteristics of the cam and lobes need to be modified. For example, the diameter of the base circle of the proposed dual-lobed cam is significantly increased and the duration is reduced in order to maintain a sufficient operational lift.

By slowing the rotational speed of an engine component, such as the camshaft, the component may be turned more easily by using less torque or power, thereby allowing more power to return to or be retained by the output of the engine. This may result in better efficiency and/or more power. For instance, by reducing the gear ration between the camshaft and crankshaft to 4:1, the necessary torque required to turn the camshaft is reduced significantly, and in many cases, by half. Furthermore, if the diameter of the base circle of the cam(s) is increased, a more gradual approach to the acceleration ramps may be used for the lobes, thereby allowing the camshaft to open or displace the valves with less resistance, adding to the efficiency of the engine. Moreover, the slower camshaft speed, combined with the improved lobe design and configuration could cause the valve train to operate in a more stable manner at higher RPMs, and could allow for a lighter valve spring.

SUMMARY OF THE INVENTION

The present invention is generally directed to a dual-lobed cam of an internal combustion engine, a camshaft including a plurality of dual-lobed cams, and an engine assembly employing the camshaft with dual-lobed cams. In particular, the dual-lobed cams are structured to reduce the rotational speed of the camshaft allowing a single cam to drivingly engage a valve assembly (e.g., via contact with a valve, push rod, etc.) twice for each revolution of the camshaft. By reducing the rotational speed of the camshaft, the torque or power required to rotate the camshaft is reduced, thereby increasing the overall efficiently and power of the engine.

Specifically, the improved cam includes an enlarged base circle region defined by an enlarged diameter greater than fifty millimeters (50 mm). Some embodiments include a base circle diameter of approximately one hundred and fifty millimeters (150 mm) or more, although a preferred embodiment has a base circle diameter of approximately in the range of one hundred millimeters (100 mm).

Furthermore, as should be apparent from the description provided herein, the improved cam(s) include at least two outwardly extending lobes each defining a lift region between the base circle and the outer surface of the lobe. The net lift of the various embodiments may vary, particularly depending on the application, engine requirements, etc., although in certain exemplary embodiments, the net lift imparted by each of the lobes of a single cam may be in the range of between eight millimeters (8 mm) and ten millimeters (10 mm).

Moreover, the each of the lobes include a duration, which is measured by an angular representation of the base circle within which the lobe is defined (i.e., begins and ends). The duration of the various embodiments may vary depending on the actual implementation, engine requirements or specifications, etc., however in at least one exemplary embodiment of the present invention, the duration may be in the range of sixty (60) degrees and seventy (70) degrees measured in the base circle of the corresponding cam.

Leading and trailing acceleration ramps preceding and following the peak or nose of the lobe define the beginning and end of the corresponding lobe. In at least one embodiment, and in order to allow an improved acceleration while providing a sufficient lift and maintain the base circle diameter at a desired dimension (e.g., in the range of 100 mm), the acceleration ramps may be defined by an external arc or concave surface configuration generating a roller profile or roller cam profile. Particularly, the external arc is defined by a center point or axis positioned external to the base circle, thereby imparting the concave configuration on the acceleration ramp.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

As shown in the accompanying drawings, the present invention is directed to a new and improved dual-lobed cam, generally referenced as 10, for a camshaft 12 of an internal combustion engine 1. As provided herein, certain embodiments further include a timing assembly 40, such as a crankshaft sprocket, camshaft sprocket and one or more timing belts, timing chains, etc.

Figure 1:
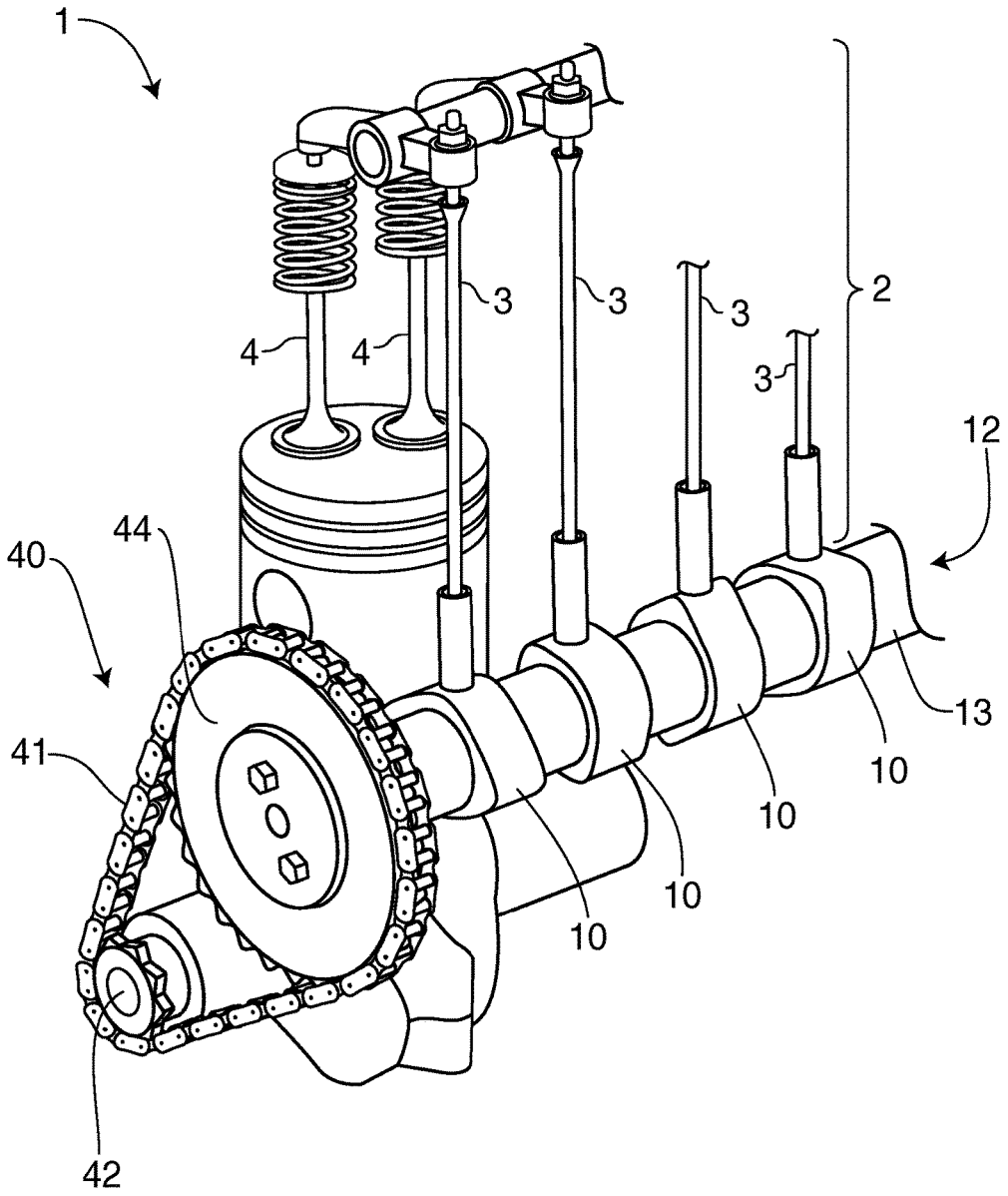
FIG. 1 is a partial perspective view of an exemplary engine assembly utilizing the dual-lobed cams as disclosed in accordance with at least one embodiment of the present invention described herein.
Figure 2:
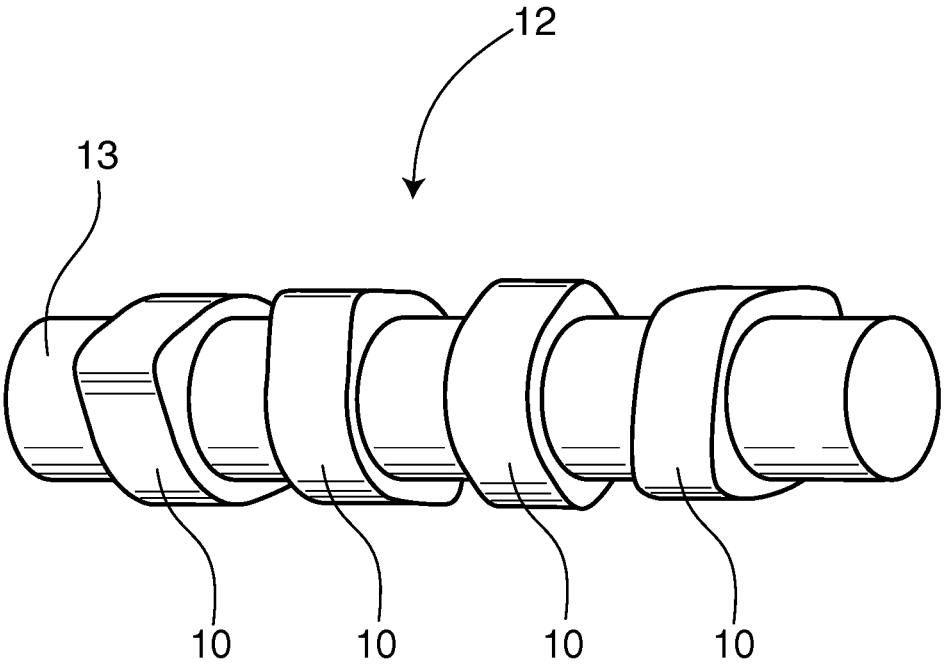
FIG. 2 is a partial perspective view of an exemplary camshaft with a plurality of dual-lobed cams disposed along a length thereof.

For example, in use, a plurality of the dual-lobed cams 10 of the present invention will generally be disposed in a spaced relation to one another along the length of a camshaft 12 (FIG. 2) for interactive disposition or driving relation with a valve assembly 2, which may include, depending on the particular engine 1, one or more valves, lifters, push rods, rocker shaft(s), valve spring(s), etc. Particularly, in the illustrative set-up or embodiment shown in FIG. 1, the dual lobed cams 10 of the camshaft 12 are disposed in a driving relation with corresponding push rods 3, which in turn manipulate the corresponding valves 4 via the interconnected structures of the valve assembly 2. Roller style lifters 3 may be implemented, although they are not necessary for the operation of the various embodiments of the present invention. It should be noted that other configurations may be implemented depending on the particular engine 1, vehicle, etc.

Accordingly, as should be apparent from the description provided herein, the dual-lobed cam(s) 10 of the various embodiments of the present invention are not limited for use with any particular engine 1, or with any particular valve train configuration, whether a single overhead camshaft (SOHC) configuration, a dual overhead camshaft (DOHC) configuration, or other configuration or layout, as desired or implemented.

Figure 3:
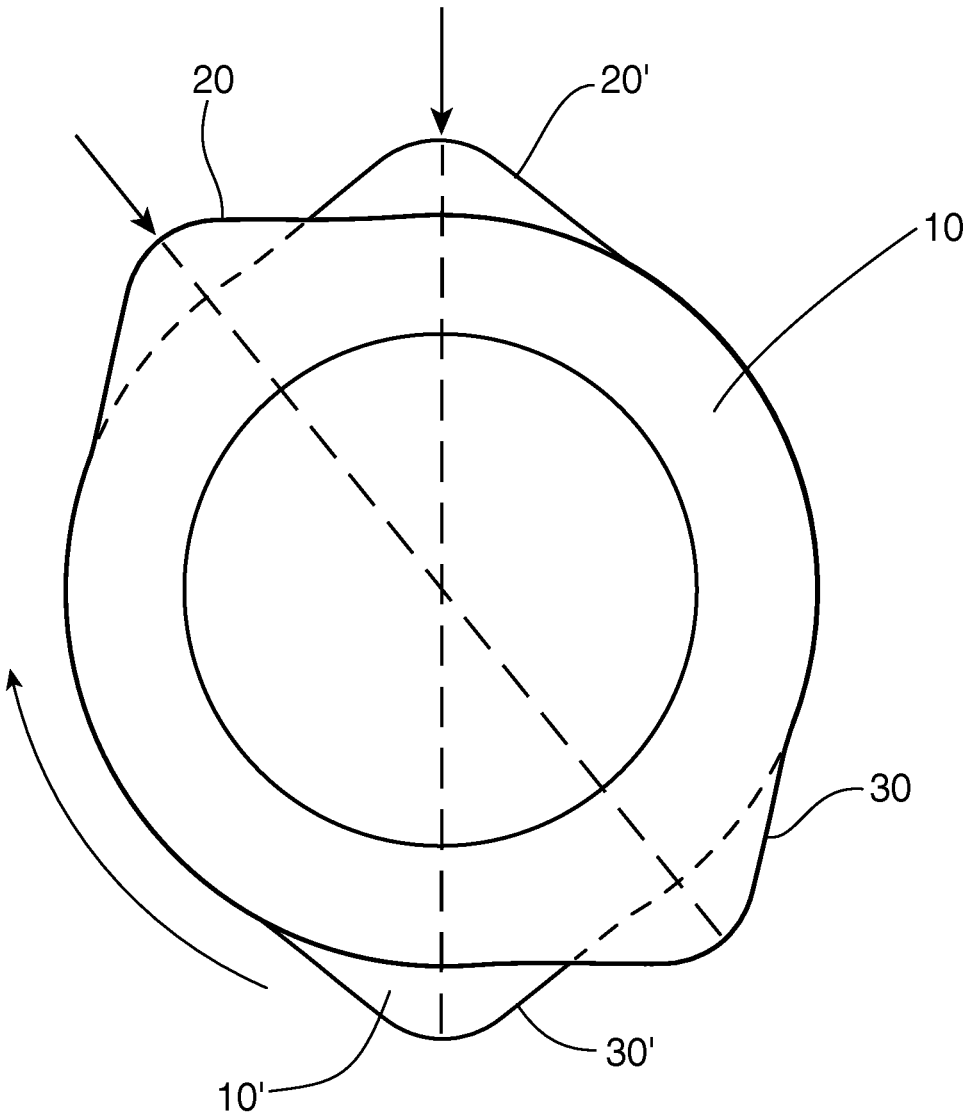
FIG. 3 is an end elevation view of two dual-lobed cams as disclosed in accordance with at least one embodiment herein.

Referring to the end elevation view of FIG. 3, the dual-lobed cams 10 of at least one embodiment of the present invention are shown. Particularly, each dual-lobed cam 10, 10' comprises two, oppositely disposed lobes 20, 30 and 20', 30', respectively. As such, the lobes 20, 30 of a single or common dual-lobe cam 10 will manipulate the valve assembly 2 twice for each revolution of the cam 10 or camshaft 12. Accordingly, the rotational speed of the camshaft 12 utilizing the dual-lobed cams 10 of the present invention may be approximately half of the rotational speed of a typical single-lobed cam, which may also be one-fourth of the rotational speed of the corresponding or interconnected crankshaft. It should be noted that the lobe separation angle and cooperative positioning of the cams 10, 10' shown in FIG. 3 are merely for illustrative, non-limiting purposes in that the lobe separation angle and/or cooperative positioning of the cams 10, 10' relative to one another may vary depending on the particular engine or vehicle in which the present invention is employed.

Specifically, referring again to FIG. 1, the timing assembly 40 of at least one exemplary implementation of the engine 1 includes a crankshaft sprocket 42 and a camshaft sprocket 44 interconnected to one another, for example, via a timing belt, timing chain, etc., generally referenced as 41. In at least one embodiment of the present invention, the camshaft sprocket 44 may be configured to be approximately four times larger than the corresponding or interconnected crankshaft sprocket 42. This allows the camshaft sprocket 42 and the connected camshaft 12 to comprise a rotational speed of one fourth the rotational speed of the crankshaft or crankshaft sprocket 42. Thus, the camshaft 12 of the embodiment illustrated in FIG. 1, would turn one revolution for every eight strokes of a four stroke internal combustion engine.

Accordingly, by slowing down the rotational speed of the camshaft 12 (e.g., half the speed of a conventional four stroke internal combustion engine), the camshaft 12 may be turned or rotated more easily, thereby allowing the engine to use its power in another manner. This would result in an engine having higher efficiency and/or more power. Furthermore, as will be described herein, the size or dimension of at least one embodiment of the dual-lobed cam 10 of the present invention includes a greater or larger diameter than conventional single-lobed cams, allowing the valves to open in a more gradual manner, with less resistance, thereby adding efficiency to the engine 1 as a whole.

For example, as will be provided below with regard to the various exemplary embodiments of the present invention described herein, the dual-lobed cam 10 may include a diameter of greater than fifty millimeters (50 mm), and in some instances, as large as or larger than one hundred millimeters (100 mm) or one hundred and fifty millimeters (150 mm). As such, the diameter of the dual-lobed cam 10 of certain embodiments presented herein is much greater than a conventional single-lobed cam, and in some cases may be greater than three times or even five times the diameter thereof.

Figure 4A:
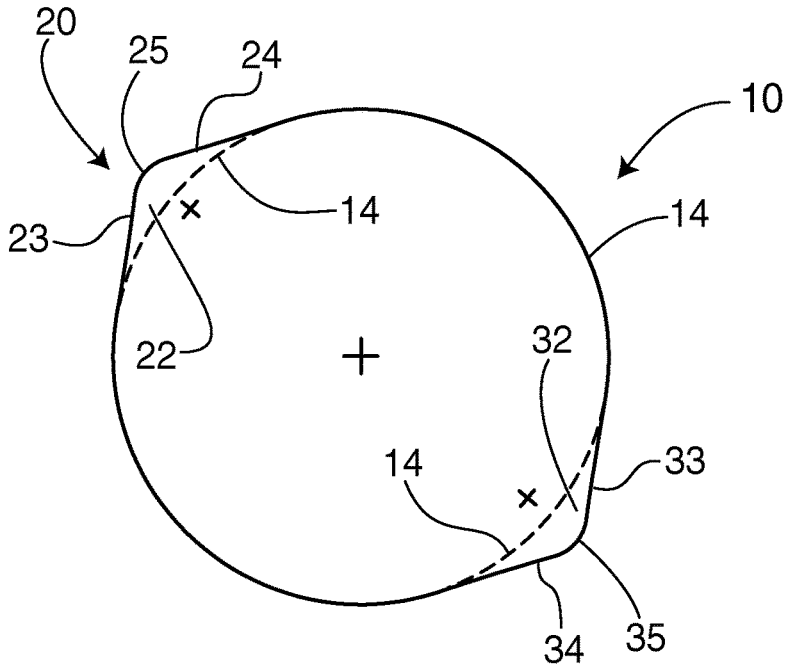
FIG. 4A is a side schematic view of at least one embodiment of the dual-lobed cam disclosed herein.
Figure 4B:
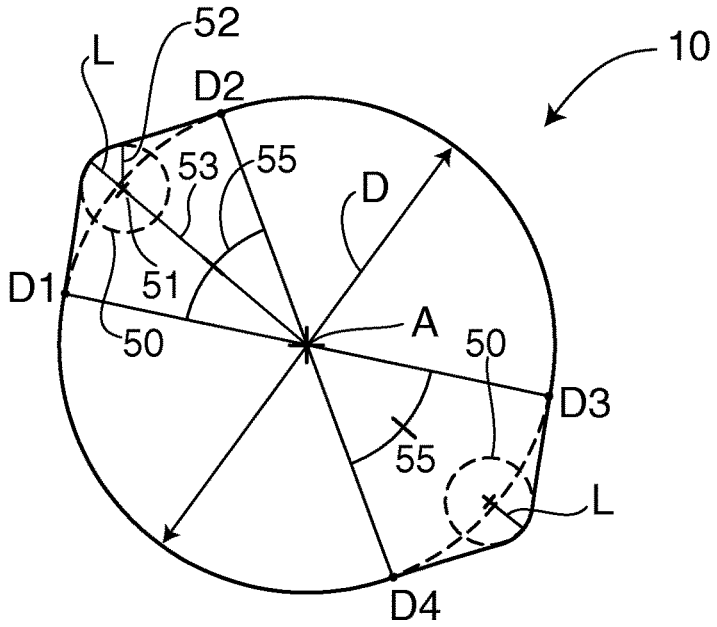
FIG. 4B is another side schematic view of the embodiment of the dual-lobed cam illustrated in FIG. 4A.

Referring now to the exemplary embodiment illustrated in FIGS. 4A and 4B, the dual lobed cam 10 comprises a base circle region 14, which defines the inner portion of the cam 10. In operation, the base circle region 14 will be circumferentially disposed around the shaft 13 (FIG. 2) of the camshaft 12, with the outer lobes 20, 30 extending outwardly therefrom. In particular, first and second lobes 20, 30 are disposed outwardly from opposite sides the base circle region 14, as shown in FIG. 4A, for example. The first and second lobes 20, 30 are structured to define first and second lift regions 22, 32 between the corresponding lobe 20, 30 and the base circle region 14. The lift region 22, 32 is what ultimately creates the net displacement of the valve 4 from its seat or resting position as the rotating cam 10 comes into contact with the valve assembly 2. In certain embodiments, the first and second lobes 20, 30 of a common cam 10 comprise identical structural configurations and dimensions, although it is contemplated that the configurations and/or dimensions may vary.

Furthermore, the first and second lobes 20, 30 define first and second lobe noses 25, 35, respectively. The lobe nose 25, 35 is the peak point or topmost end of the corresponding lobe 20, 30, which, in turn, corresponds to the point of the cam 10 where the valve 4 will reach its largest displacement. Leading and trailing acceleration ramps 23, 24 and 33, 34 define the outermost ends of the lobes 20, 30 between duration points D1, D2 and D3, D4, for example. The duration of the lobe 20 is the angular region of the base circle between the first and second duration points D1 and D2, for example, where the lobe 20 is disposed.

Referring now to the exemplary embodiment of FIG. 4B, the lobe nose 25, and at least a portion of the leading and/or trailing ramps 23, 24 may be configured by using a guide circle or guide arc, generally shown as 50, with a center axis or center point 51 positioned within the cam 10.

In particular, still referring to FIG. 4B, the diameter D of an exemplary base circle used to generate the cam 10 may be in the range of approximately one hundred millimeters (100 mm). The lobe nose center point or axis 51, defined as the center point or axis of guide circle 50, is positioned a distance 53 from the center point or axis A1 of the base circle. In at least one exemplary embodiment, the distance 53 may be in the range of approximately the radius of the base circle or slightly less than the radius of the base circle. For instance, in the embodiment shown, the distance 53 may be approximately 49 to 50 millimeters, and in one implementation may be approximately 49.374 millimeters, although it should be apparent that other dimensions and distances 53 are certainly contemplated within the full spirit and scope of the present invention.

Furthermore, the guide circle 50 may include a radius 52 within the range of approximately eight to nine millimeters, and in one implementation may be approximately 8.947 millimeters. Thus, with a guide circle or lobe nose radius 52 of approximately 8.947 millimeters, and distance 53 being approximately 49.374 millimeters, the net lift L of the exemplary embodiment is approximately 8.321 millimeters. However, it should again be noted that these dimensions are merely illustrative in nature and should not be deemed limiting in any manner. The Lift L of the various exemplary embodiments may be in the range of between seven and eleven millimeters, although other dimensions greater or lower than this range structured to implement the present invention in the intended manner may be used.

Accordingly, in the event the engine 1 includes a rocker arm ration of 1.5:1, the maximum valve lift or maximum displacement of the valve will be approximately 12.481 millimeters. The duration, measured by angle 55 of the exemplary embodiment illustrated in FIGS. 4A and 4B may be in the range of about sixty to seventy degrees, or in a preferred embodiment, approximately 67.5 degrees, or 270 degrees at the crankshaft. It should be apparent that the dimensions provided in this example are merely for illustrative purposes only relative to the dual-lobed cam 10 of the various embodiments of the present invention, and should not be deemed limiting in any manner.

Figure 5A:
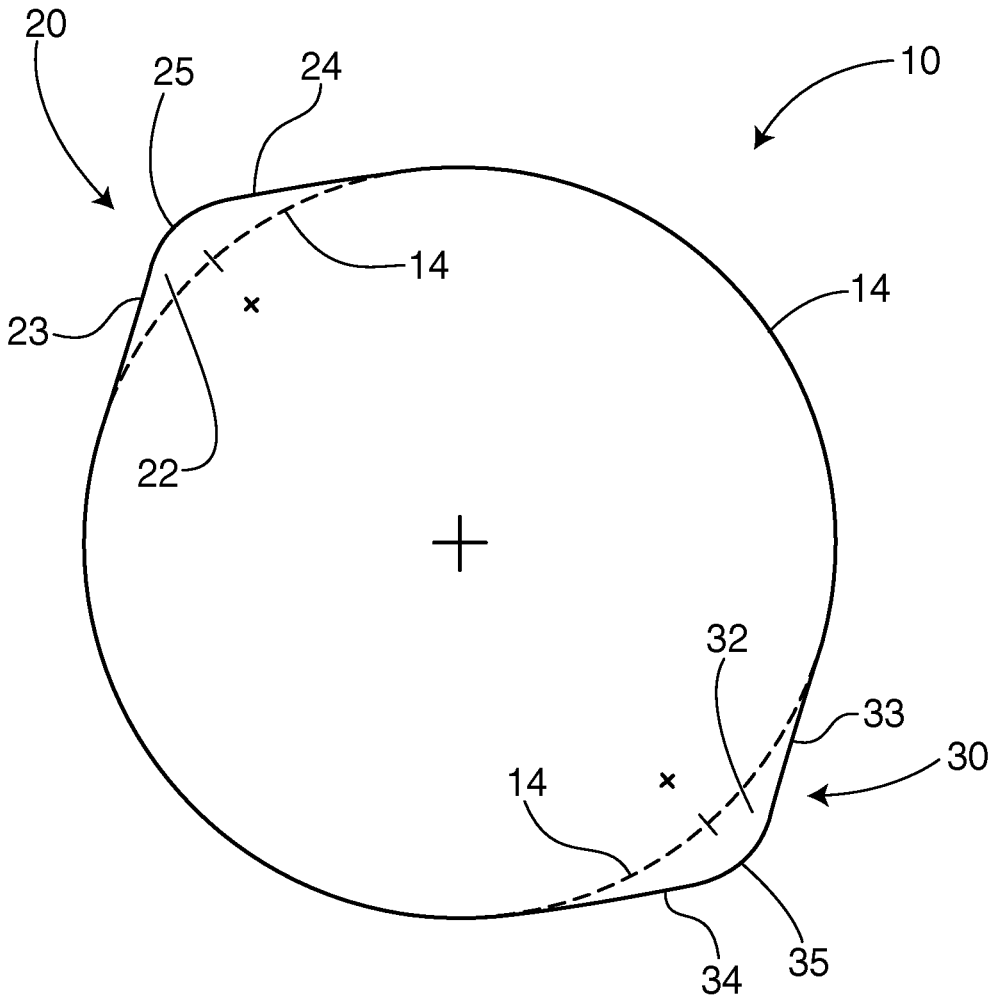
FIG. 5A is a side schematic representation of another embodiment of the dual-lobed cam disclosed herein.
Figure 5B:
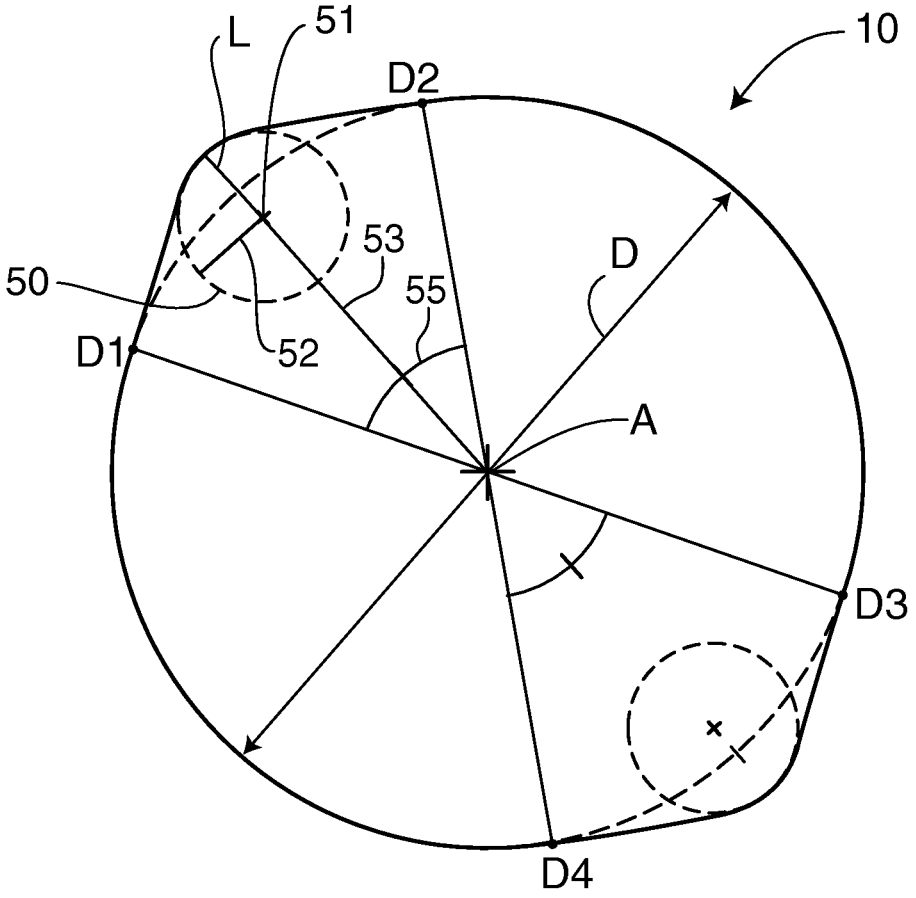
FIG. 5B is another side schematic view of the embodiment of the dual-lobed cam illustrated in FIG. 5A.

FIGS. 5A and 5B illustrate another exemplary embodiment of the dual-lobed cam 10 of the present invention. In particular, as before, the dual-lobed cam 10 comprises a base circle region 14, which defines the inner portion of the cam 10. In operation, the base circle region 14 will be circumferentially disposed around the shaft 13 (FIG. 2) of the camshaft 12, with the outer lobes 20, 30 extending therefrom. First and second lift regions 22, 32 are disposed between the corresponding lobe 20, 30 and the base circle region 14. Furthermore, the first and second lobes 20, 30 define first and second lobe nose 25, 35, respectively, and leading and trailing ramps 23, 24 and 33, 34 define the outermost ends of the lobes 20, 30 between duration points D1, D2 and D3, D4, for example.

In order to eliminate potential "lofting" or "bouncing" due to the valves 4 opening or displacing too fast, as compared to the example illustrated in FIGS. 4A and 4B, the exemplary embodiment illustrated in FIGS. 5A and 5B may be constructed with a larger base circle 14, a slightly larger lift region 22, 32, less duration 55, a quicker or steeper leading ramp 23, 33, and a broader lobe nose 25, 35. Exemplary dimensions for the embodiment illustrated in FIGS. 5A and 5B, are provided herein.

In particular, with reference to FIG. 5B, the diameter D of the exemplary base circle may be in the range of approximately one hundred and fifty millimeters (150 mm). The lobe nose center point or axis, defined as the center point or axis of guide circle 51, is positioned a distance 53 from the center point or axis A of the base circle. In at least one embodiment, the distance 53 is in the range of sixty to sixty five millimeters and in an exemplary implementation, the distance 53 is approximately 63.613 millimeters, although other dimensions are certainly contemplated. Furthermore, the guide circle 50 may include a radius within the range of approximately twenty to twenty one millimeters, such as approximately 20.616 millimeters. This will generate a net lift L of the exemplary embodiment in the range of about nine to ten millimeters, and in one implementation, approximately 9.229 millimeters. The duration, measured by angle 55 is may be in the range of about sixty to seventy degrees, or in a preferred embodiment, approximately 67.5 degrees, or 270 degrees at the crankshaft. It should be apparent that, as above, the dimensions provided in this, and other examples are merely for illustrative purposes only relative to the dual-lobed cam 10 of the various embodiments of the present invention, and should not be deemed limiting in any manner.

Figure 6A:
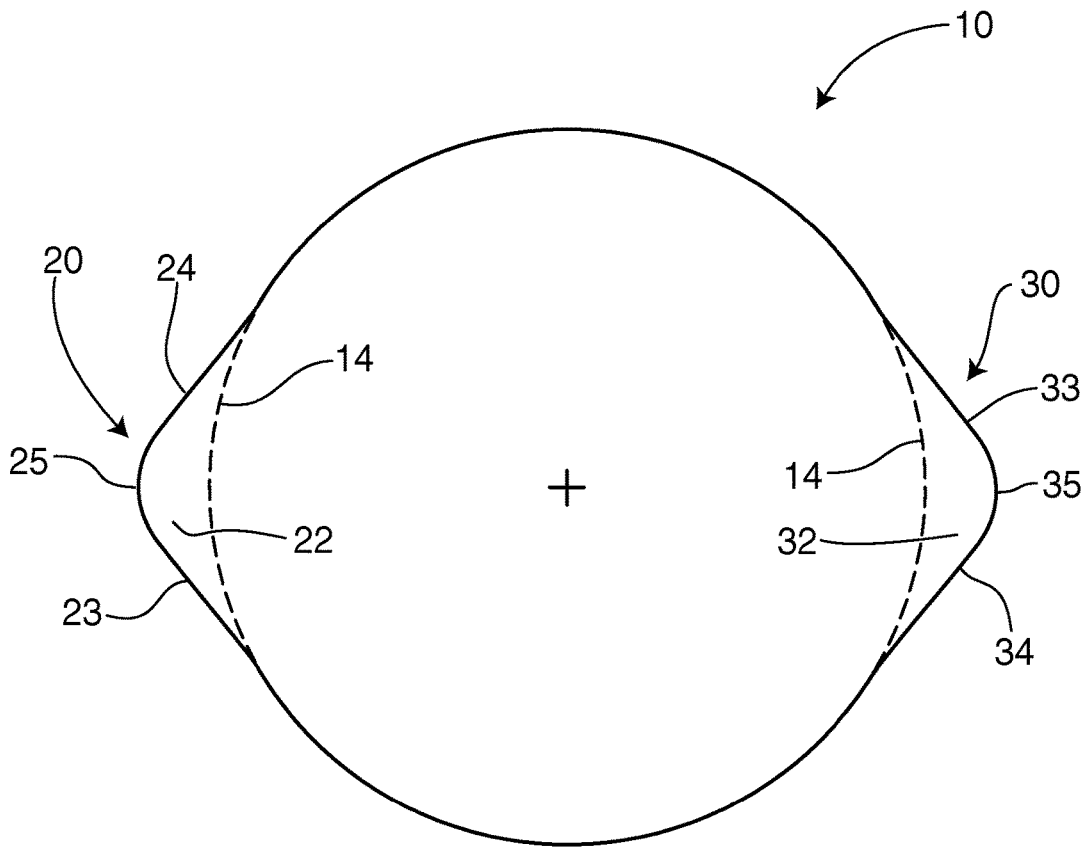
FIG. 6A is a side schematic representation of yet another embodiment of the dual-lobed cam disclosed herein.
Figure 6B:
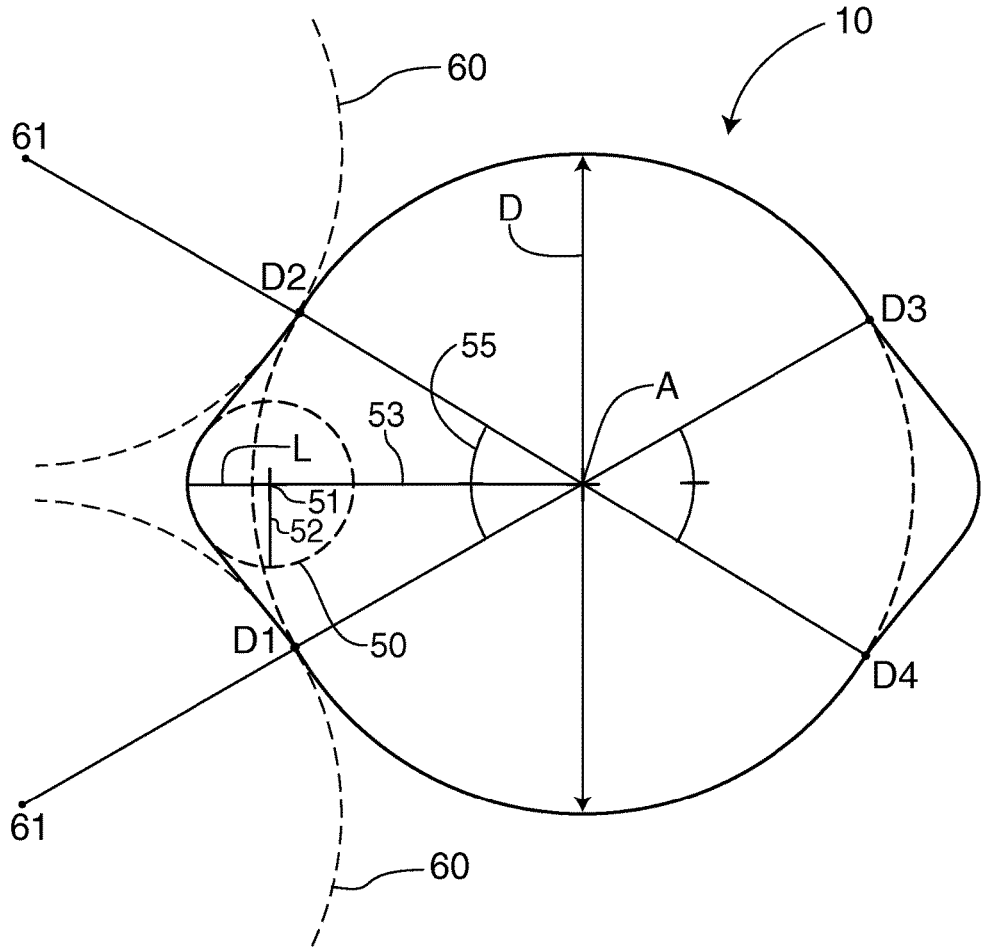
FIG. 6B is another side schematic view of the embodiment of the dual-lobed cam illustrated in FIG. 6A.

Yet another illustrative embodiment of the dual-lobed cam 10 of the present invention is provided in FIGS. 6A and 6B. For example, the first and second lobes 20, 30 of the dual-lobed cam 10 shown in FIGS. 6A and 6B are constructed in a manner that provide greater lift while maintaining low duration and maintaining the diameter of the cam or base circle 14 within or at approximately one hundred millimeters (100 mm). In particular, one or both of the lobe ramps 23, 24 of a common lobe 20 may be constructed with a reverse curve, or a curve that dips slightly inward toward the lobe 20 or cam 10. For example, as shown best in FIG. 6B, an external arc 60 may be used to at least partially define the curve associated with the at least one ramp 23, 24, and particularly, the leading ramp 23. Specifically, the external arc 60 includes a center point or axis 61 disposed at a position external to or outside of the base circle 14. It should be noted that in certain embodiments, the leading and trailing ramps 23, 24 of a common lobe 20 may be symmetrical and defined by the same external arc 60. Other embodiments allow for asymmetrical lobes 20 within the scope of the present invention. It should be noted that the external arc(s) 60 of at least one embodiment used to at least partially define one or more acceleration or lobe ramps 23, 24 may include a radius of greater than ninety millimeters (90 mm).

Furthermore, in certain embodiments, the external arc 60 that is used to at least partially define one or both of the ramps 23, 24 of a common lobe may intersect the base circle 14 at a location defined by a duration point D1, D2. For instance, as provide herein, the duration of the lobe 20 is defined by the angular region of the base circle 14 between the corresponding duration points where the lobe is disposed. The duration points define the beginning and the end of the corresponding lobe 20. In at least one exemplary embodiment, the duration 55 of at least one or both of the lobes 20, 30 of a common dual-lobed cam 10 may be less than seventy (70) degrees, or between sixty (60) and seventy (70) degrees. Accordingly, the lift L provided by the lobes 20, 30 of the embodiment illustrated in FIGS. 6A and 6B will be greater than about eight millimeters (8 mm) and, in certain implementations about ten millimeters (10 mm).

Moreover, exemplary, non-limiting dimensions for the embodiment illustrated in FIGS. 6A and 6B are provided herein. In particular, with reference again to FIG. 6B, the diameter D of an exemplary base circle may be in the range of approximately one hundred millimeters (150 mm). The duration, measured by angle 55 may be approximately sixty to seventy degree, or in one implementation, about 62.5 degrees, or 250 degrees at the crankshaft. The external arc(s) 60, used to at least partially define the acceleration or lobe ramp(s) 23, 24 may include a radius of approximately ninety to one hundred millimeters, and in one implementation, may be in the range of approximately ninety seven millimeters (97 mm). Of course, as before, it should be apparent that the dimensions provided in this example are merely for illustrative purposes only relative to the dual-lobed cam 10 of the various embodiments of the present invention, and should not be deemed limiting in any manner.

Furthermore, the lobe nose center point or axis, defined as the center point or axis of guide circle 51, is positioned a distance 53 from the center point or axis A of the base circle. Furthermore, in at least one embodiment, the distance 53 is in the range of forty five to fifty millimeters and in an exemplary implementation, the distance 53 is approximately 47.288 millimeters, although, as before, other dimensions are certainly contemplated within the full spirit and scope of the present invention. Furthermore, the guide circle 50 may include a radius within the range of approximately ten to fifteen millimeters, such as approximately 12.77 millimeters in one implementation. This will generate a net lift L of the exemplary embodiment in the range of about nine to ten millimeters, and in one implementation, approximately 9.998 millimeters.

Figure 7:
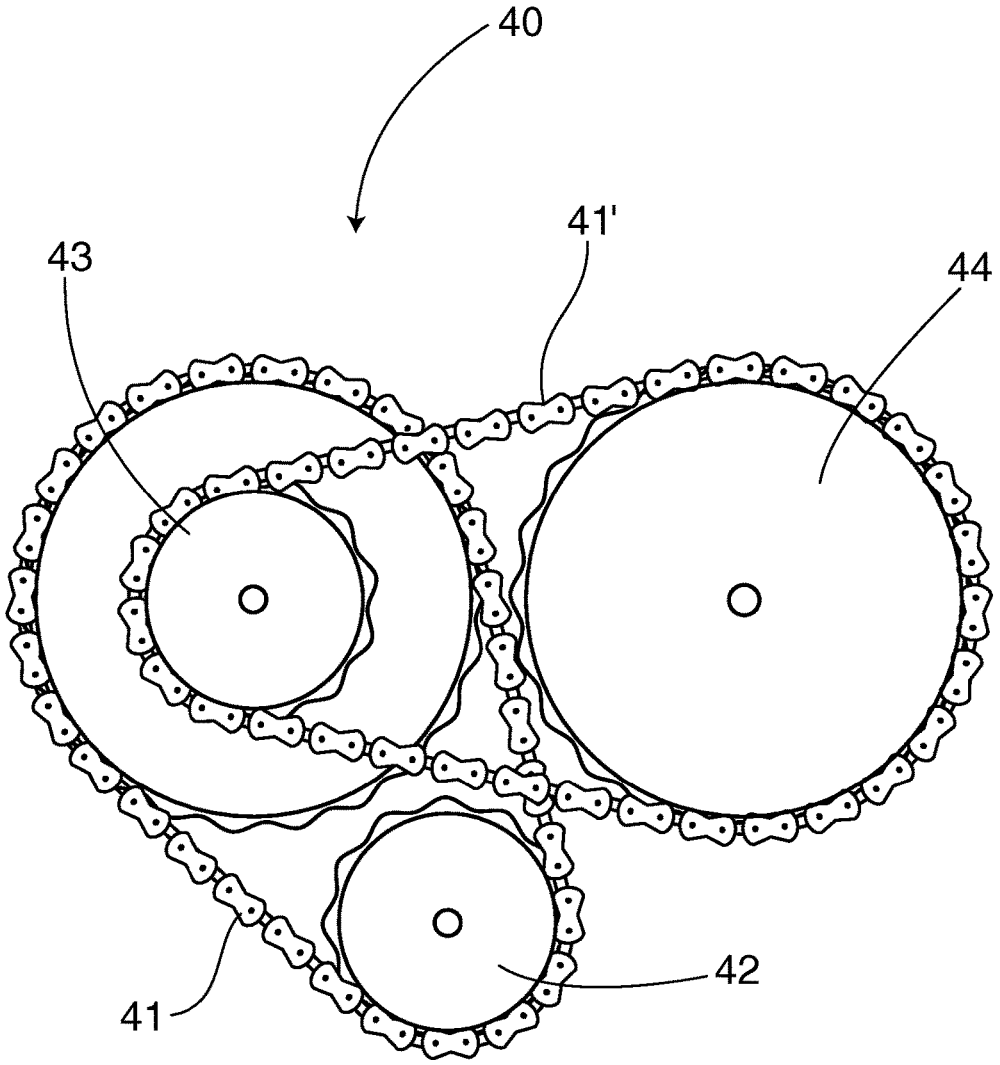
FIG. 7 is a side view of an exemplary timing assembly as disclosed in accordance with at least one embodiment of the present invention provided herein.

Referring now to FIG. 7, a modified timing assembly 40 is shown which includes an intermediate or reducer sprocket 43 disposed between and/or in an interconnected relation with the cam sprocket 44 via a series of timing belts, chains, etc, represented as 41 and 41'. In particular, in the embodiment illustrated in FIG. 7, the camshaft sprocket 44 will include a rotational speed of one-fourth the rotational speed of the crank shaft sprocket 42 when the diameter of the camshaft sprocket 44 is four times larger than the diameter of the crank shaft sprocket 42. For instance, the intermediate or reducer sprocket 43 may include a dimension or diameter of twice the diameter of the crank shaft sprocket 41 and half of the diameter of the cam shaft sprocket 44. This will allow the cam shaft sprocket 44 to rotate a one-fourth the speed of the crank shaft sprocket 41, thereby facilitating implementation of the various dual-lobed cams 10 described herein. Other dimensions, diameters and ratios between the crankshaft sprocket 41, intermediate or reducer sprocket 43 and camshaft sprocket 44 may be implemented within the spirit and scope of the various embodiments of the present invention.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. A dual-lobed cam for a camshaft of an internal combustion engine, the camshaft comprising an elongated shaft rotationally disposed in relation to a crankshaft via a timing assembly, said dual-lobed cam comprising:

a base circle region circumferentially disposed around the camshaft, said base circle region comprising a diameter greater than fifty millimeters (50 mm), a first lobe and a second lobe each extending at least partially outward from said base circle region, said first lobe defining a first lift region off of said base circle region, said first lobe being at least partially defined by two curved acceleration ramps disposed on opposite sides of a first lobe nose, said curved acceleration ramps of said first lobe comprising an at least partially concave configuration, said first lobe comprising a lift between seven millimeters (7 mm) and eleven millimeters (11 mm), said lift of said first lobe defined as the distance between the base circle region and a first lobe nose, said first lobe further comprising a duration between fifty degrees (50°) and eighty degrees (80°), said duration of said first lobe being defined as an angular region of said base circle region defining said first lobe, said second lobe defining a second lift region off of said base circle region, said second lobe being at least partially defined by two curved acceleration ramps disposed on opposite sides of a second lobe nose, said curved acceleration ramps of said second lobe comprising an at least partially concave configuration, said second lobe comprising a lift between seven millimeters (7 mm) and eleven millimeters (11 mm), said lift of said second lobe defined as the distance between the base circle region and a second lobe nose, said second lobe further comprising a duration between fifty degrees (50°) and eighty degrees (80°), said duration of said second lobe being defined as an angular region of said base circle region defining said second lobe, and wherein said first lobe and said second lobe are disposed on opposite sides of said base circle region.

2. The dual-lobed cam as recited in claim 1 wherein the camshaft rotates one complete rotation for every four complete rotations of the crankshaft.

3. The dual-lobed cam as recited in claim 1 wherein said base circle region comprises a diameter of at least one hundred millimeters (100 mm).

4. The dual-lobed cam as recited in claim 3 wherein said diameter of said base circle region is approximately one hundred millimeters (100 mm).

5. The dual-lobed cam as recited in claim 4 wherein said concave configuration of at least one of said curved acceleration ramps of said first lobe is defined by an external arc provided by a circle with a center point disposed external to said first lobe.

6. The dual-lobed cam as recited in claim 5 wherein both of said two curved acceleration ramps of said first lobe are defined by corresponding external arcs provided by circles with center points disposed external to said first lobe.

7. The dual-lobed cam as recited in claim 6 wherein said first lobe and said second lobe comprise identical configurations.

8. The dual-lobed cam as recited in claim 6 wherein said corresponding external arcs and said base circle intersect at first and second duration points.

9. The dual-lobed cam as recited in claim 8 wherein said corresponding external arcs comprise radiuses of greater than ninety millimeters (90 mm).

10. The dual-lobed cam as recited in claim 9 wherein said corresponding external arcs comprise radiuses of about ninety seven millimeters (97 mm).

11. The dual-lobed cam as recited in claim 10 wherein said first lobe comprises a lift of greater than nine millimeters (9 mm).

12. The dual-lobed cam as recited in claim 11 wherein said first lobe comprises a lift of approximately ten millimeters (10 mm).

13. The dual-lobed cam as recited in claim 12 wherein said first lobe and said second lobe comprise identical configurations.

14. A dual-lobed cam of an internal combustion engine, said dual-lobed cam comprising:

a base circle region, a first lobe defining a first lift region of off said base circle region, said first lobe being at least partially defined by two curved acceleration ramps disposed on opposite sides of a first lobe nose, said curved acceleration ramps of said first lobe comprising an at least partially concave configuration defined by an external arc provided by a circle with a center point disposed external to said first lobe, a second lobe defining a second lift region off of said base circle, said second lobe being at least partially defined by two curved acceleration ramps disposed on opposite sides of a second lobe nose, said curved acceleration ramps of said second lobe comprising an at least partially concave configuration defined by an external arc provided by a circle with a center point disposed external to said second lobe, said first lobe and said second lobe being disposed one hundred and eighty degrees from one another relative to said base circle region, said base circle region comprising a diameter of at least approximately one hundred millimeters (100 mm), said first lobe and said second lobe comprising a duration of between sixty degrees and seventy degrees, wherein said duration is defined as an angular region of said base circle wherein said corresponding one of said first lobe and said second lobe is disposed, and said first lobe and said second lobe each comprise a lift between approximately eight millimeters (8 mm) and ten millimeters (10 mm).

15. The dual-lobed cam as recited in claim 14 wherein said cam rotates one full revolution for every four full revolutions of an interconnected crankshaft.

16. A camshaft for an internal combustion engine, said camshaft comprising:

a plurality of dual-lobed cams disposed in a spaced relation along a length of said camshaft, each of said plurality of dual-lobed cams comprising identical configurations, wherein said plurality of dual lobed cams each comprise:

a base circle region comprising a diameter of at least fifty millimeters (50 mm), a first lobe defining a first lift region of off said base circle region, and a second lobe defining a second lift region off of said base circle, said first lobe being defined by at least one acceleration ramp and a first lobe nose, said acceleration ramp of said first lobe comprising a concave configuration at least partially defined by an external arc with a central point disposed external to said first lobe, said first lobe comprising a lift greater than seven millimeters (7 mm), said lift of said first lobe being defined as the distance between said base circle region and said first lobe nose, said first lobe further comprising a duration between sixty degrees (60°) and seventy degrees (70°), said duration of said first lobe being defined as an angular region of said base circle region defining said first lobe, said second lobe being defined by at least one acceleration ramp and a second lobe nose, said acceleration ramp of said second lobe comprising a concave configuration at least partially defined by another external arc with a central point disposed external to said second lobe said second lobe comprising a lift greater than seven millimeters (7 mm), said lift of said second lobe defined as the distance between said base circle region and said second lobe nose, and said second lobe further comprising a duration between sixty degrees (60°) and seventy degrees (70°), said duration of said second lobe being defined as an angular region of said base circle region defining said second lobe.

17. The dual-lobed cam as recited in claim 16 wherein said external arc of said first lobe intersects said base circle region at a duration point of said first lobe, and said external arc of said second lobe intersects said base circle region at a duration point of said second lobe.

18. The dual-lobed cam as recited in claim 17 wherein said base circle comprises a diameter of at least approximately one hundred millimeters (100 mm), said external arc of said first lobe comprises a radius of at least approximately ninety millimeters (90 mm), and said external arc of said second lobe comprises a radius of at least approximately ninety millimeters (90 mm).

* * * * *